US008801367B2

(12) United States Patent
Weisse et al.

(10) Patent No.: US 8,801,367 B2
(45) Date of Patent: Aug. 12, 2014

(54) HOLLOW FAN BLADE CHANNEL CONFIGURATION TO REDUCE STRESS

(75) Inventors: Michael A. Weisse, Tolland, CT (US); Christopher S. McKaveney, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 402 days.

(21) Appl. No.: 13/241,930

(22) Filed: Sep. 23, 2011

(65) Prior Publication Data

US 2013/0078107 A1 Mar. 28, 2013

(51) Int. Cl.

| | |
|---|---|
| ***F01D 5/18*** | (2006.01) |
| ***F01D 5/16*** | (2006.01) |
| ***F01D 5/14*** | (2006.01) |
| ***F01D 5/28*** | (2006.01) |

(52) U.S. Cl.

CPC *F01D 5/147* (2013.01); *F01D 5/16* (2013.01); *F01D 5/282* (2013.01); *Y10S 416/50* (2013.01)

USPC ..... 415/119; 416/500; 416/233

(58) Field of Classification Search

USPC ..... 415/115, 119; 416/95, 96 R, 96 A, 97 R, 416/97 A, 500, 233

See application file for complete search history.

(56) References Cited

U.S. PATENT DOCUMENTS

| | | | | |
|---|---|---|---|---|
| 6,039,542 | A * | 3/2000 | Schilling et al. | 416/233 |
| 6,048,174 | A * | 4/2000 | Samit et al. | 416/233 |
| 6,364,616 | B1 | 4/2002 | Stevenson et al. | |
| 6,478,539 | B1 | 11/2002 | Trutschel | |
| 6,851,924 | B2 | 2/2005 | Mazzola et al. | |
| 6,994,524 | B2 * | 2/2006 | Owen et al. | 416/233 |
| 6,994,525 | B2 * | 2/2006 | Weisse et al. | 416/233 |
| 7,052,238 | B2 * | 5/2006 | Whitesell et al. | 416/233 |
| 7,070,391 | B2 * | 7/2006 | Weisse | 416/233 |
| 7,334,333 | B2 | 2/2008 | Palazzini et al. | |
| 7,458,780 | B2 * | 12/2008 | Weisse et al. | 416/233 |
| 2008/0014095 | A1 * | 1/2008 | Moniz et al. | 416/97 R |

FOREIGN PATENT DOCUMENTS

| | | |
|---|---|---|
| EP | 2184442 | 5/2010 |

* cited by examiner

*Primary Examiner* — Edward Look
*Assistant Examiner* — William Grigos
(74) *Attorney, Agent, or Firm* — Carlson, Gaskey & Olds, PC

(57) ABSTRACT

A fan blade has a main body extending between a leading edge and a trailing edge. Channels are formed into the main body from an open side extending toward an opposed closed side. A plurality of ribs extending across the main body intermediate the channels, the fan blade has a dovetail, and an airfoil extending radially outwardly from said dovetail. A bottom surface of the channels is defined at the closed side of the channels. Sides of the channel merge into sides of the ribs, with a compound fillet at the bottom surface. A first radius of curvature is used along the bottom, and merging into at least a second radius of curvature at the sides. The first radius of curvature is larger than the second radius of curvature.

2 Claims, 3 Drawing Sheets

HOLLOW FAN BLADE CHANNEL CONFIGURATION TO REDUCE STRESS

BACKGROUND

This application relates to a hollow fan blade for a gas turbine engine, wherein a unique rib geometry is utilized.

Gas turbine engines may be provided with a fan for delivering air to a compressor section. From the compressor section, the air is compressed and delivered into a combustion section. The combustion section mixes fuel with the air and combusts the combination. Products of the combustion pass downstream over turbine rotors, which in turn are driven to rotate and rotate the compressor and fan.

The fan may include a rotor having a plurality of blades.

One type of fan blade is a hollow fan blade having a plurality of channels defined by intermediate ribs in a main fan blade body. An outer skin is attached over the main fan blade body to close off the cavities. The blades are subject to a number of challenges, including internal stresses that vary along a length of the fan blade.

SUMMARY

A fan blade has a main body extending between a leading edge and a trailing edge. Channels are formed into the main body from an open side extending toward an opposed closed side. A plurality of ribs extending across the main body intermediate the channels, the fan blade has a dovetail, and an airfoil extending radially outwardly from said dovetail. A bottom surface of the channels is defined at the closed side of the channels. Sides of the channel merge into sides of the ribs, with a compound fillet at the bottom surface. A first radius of curvature is used along the bottom, and merging into at least a second radius of curvature at the sides. The first radius of curvature is larger than the second radius of curvature.

BRIEF DESCRIPTION OF THE DRAWINGS

The invention will be described with regard to the specific and drawings, the following of which is a brief description.

DETAILED DESCRIPTION

Figure 1A:
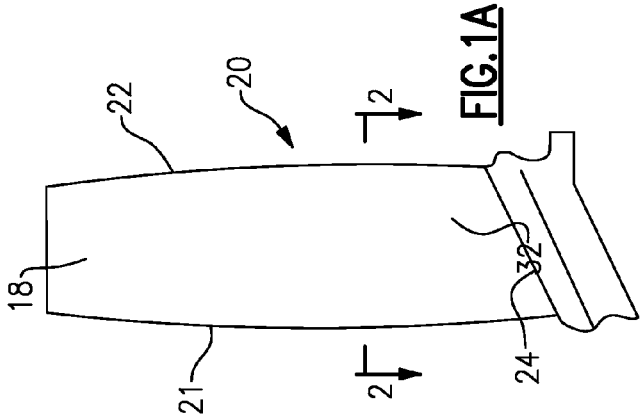
FIG. 1A shows a fan blade.

A fan blade 20 is illustrated in FIG. 1A having an airfoil 18 extending radially outwardly from a dovetail 24. A leading edge 21 and a trailing edge 22 define the forward and rear limits of the airfoil 18.

Figure 1B:
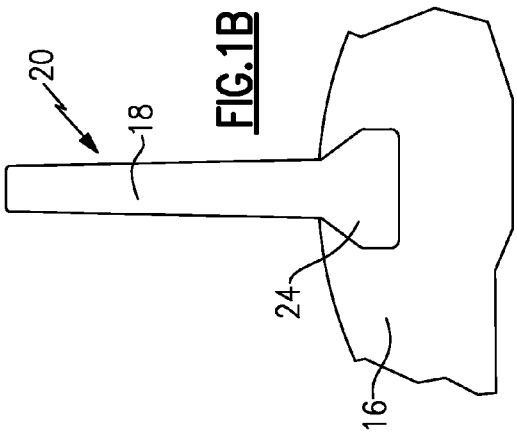
FIG. 1B shows another feature of the FIG. 1A fan blade.

As shown in FIG. 1B, a fan rotor 16 receives the dovetail 24 to mount the fan blade 20 with the airfoil 18 extending radially outwardly. As the rotor 16 is driven to rotate it carries the fan blades 20 with it. There are higher stresses adjacent to the rotor 16, than occur radially outwardly of the rotor.

Figure 2:
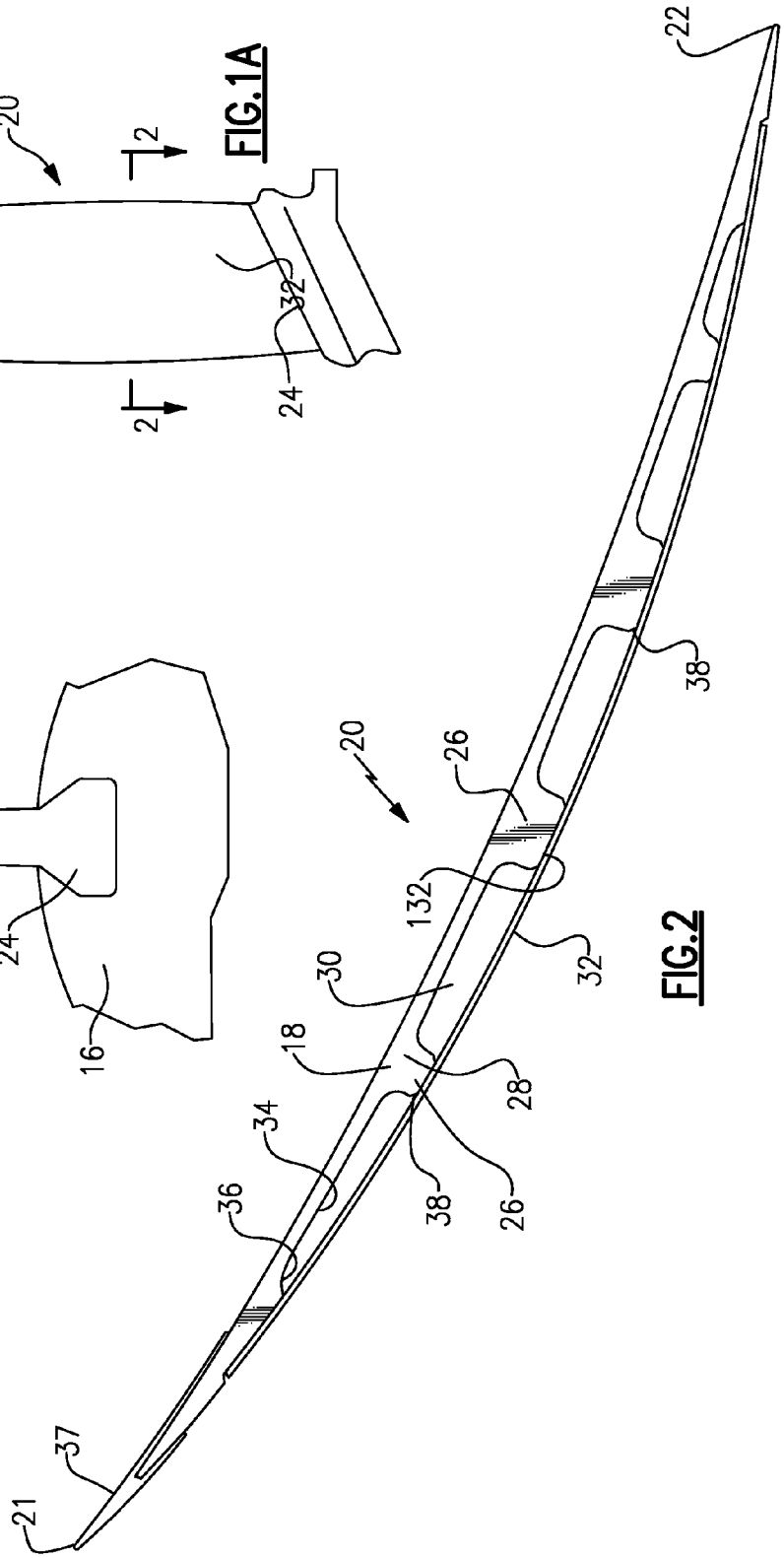
FIG. 2 is a cross-sectional view along line 2-2 as shown in FIG. 1A.

FIG. 2 shows a cross-section of the fan blade 20, at the airfoil 18. As shown, the leading edge 21 carries a cap 37 secured to a main body 28. A cover skin 32 closes off cavities or channels 30 in the main body 28. The main body 28, the cap 37 and the skin 32 may all be formed of various aluminum alloys. While aluminum alloys or aluminum may be utilized, other materials, such as titanium, titanium alloys, or other appropriate metals may be utilized.

As shown, a plurality of ribs 26 separate channels 30 in the cross-section illustrated in FIG. 2. These channels 30 are closed off by the skin 32. As shown, the channels 30 extend from an open end inwardly to a closed side. The open end is closed off by skin 32. It is within the scope of this invention, however, that the channel extends across the width of the main body 28, and there are two skins on opposed sides of the main body 28.

In addition, the channels may be filled with lighter weight filler material to provide stiffness, as known.

A contact area 132 at the forward face of the ribs 26 serves as a mount point for the skin 32, and receives an adhesive. Chamfers 38 are formed at the break-edges, or the edges of the ribs 26, and will be described in more detail below. As shown, the channels 30 have a side extent formed by a compound radius 34 and 36, again to be described in greater detail below.

Figure 3:
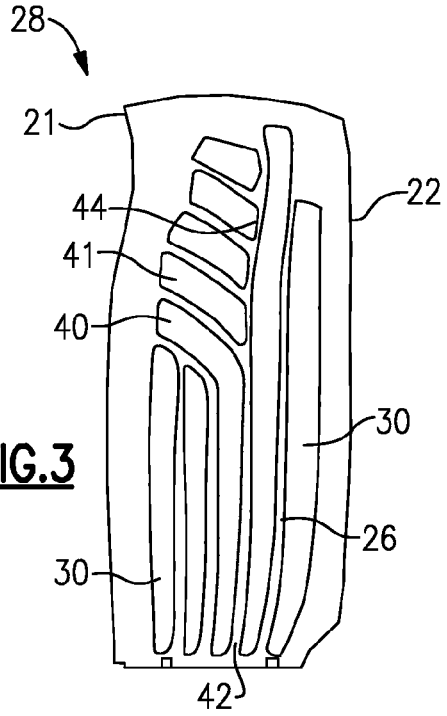
FIG. 3 shows a main body of the FIG. 1A fan blade.

FIG. 3 shows the main body 28. There are a plurality of channels 30 from the front or leading edge 21, to the back or trailing edge 22, and varying from the radially inner end toward the radially outer tip. As shown, some of the channels 30 extend generally radially upwardly. Other channels, such as channel 40, bend toward the leading edge 21. Other channels 41 simply extend generally from the middle of the main body 28 toward the leading edge 21.

To reduce the weight, it is desirable to maximize the amount of channels and minimize the amount of rib. However, there is also a need for additional stiffness adjacent the radially inner edge 42, to provide greater durability, and minimize blade pull. Thus, the ribs 26 may be formed such that they tend to be thicker adjacent a radially inner edge 42, and become thinner when moving toward the radially outer portions 44.

It is also desirable to form a blade which avoids certain operational modes across the engine operational range. Additional mass toward the tip or outer end of the blade raises challenges against tuning away from fundamental modes.

Figure 4:
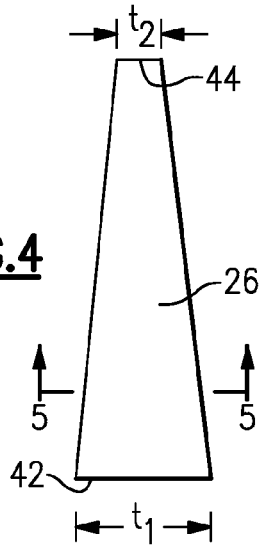
FIG. 4 is a simplified view of one rib.

As shown schematically in FIG. 4, ribs 26 are thinner at radially outer end 44 than at the inner end 42. A thickness $t_1$ at the radially inner end 42 is greater than then the thickness $t_2$ at the tip or radially outer end 44. In embodiments, a ratio of $t_1$ to $t_2$ may be between 1.1 and 8. As can be appreciated from FIG. 3, the variation need not be linear as shown in FIG. 4, and may be different across the several ribs.

Figure 5A:
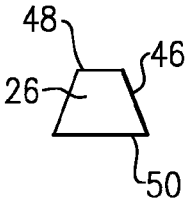
FIG. 5A is a first embodiment taken along line 5-5 of FIG. 4.

As shown in FIG. 5A, a cross-section through the rib could be a trapezoid as shown in FIG. 5A, wherein the bottom 50, which extends into the main body 28, is larger than the outer end 48 which attaches to the skin 32. Sides 46 are angled between the two ends 48 and 50.

Figure 5B:
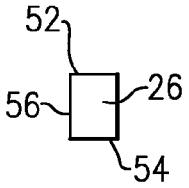
FIG. 5B is a second embodiment taken along line 5-5 of FIG. 4.

FIG. 5B shows a rectangular cross-section for the rib 26 wherein the ends 52 and 54 are generally of the same thickness, and the sides 56 are generally perpendicular to those ends.

Figure 5C:
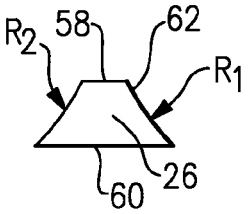
FIG. 5C is a third embodiment taken along line 5-5 of FIG. 4.

FIG. 5C shows yet another embodiment, wherein the ends 58 and 60 are of different thicknesses, and the sides 62 curve relative to each other along a particular radius.

By modifying these several variables, a designer is able to tune or optimize the operation of the fan blade for its use in a gas turbine engine.

The features of the thinner ribs are disclosed in co-pending U.S. patent application Ser. No. 13/241,756, filed on even date herewith, and entitled "HOLLOW FAN BLADE RIB GEOMETRY."

Notably, as will be explained below, it is desirable that the upper end 48/52/58 actually has a more complex surface at its break-edges.

Figure 6A:
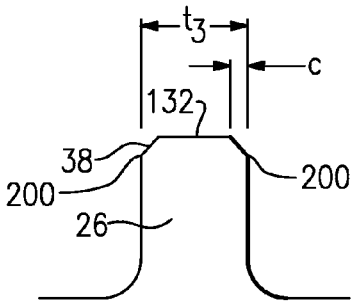
FIG. 6A is a first embodiment rib break-edge.

FIG. 6A shows the actual break-edge 38 on a rib 26. The contact area 132 which will actually contact the skin, and provide a surface for receiving adhesive and securing the skin should be maximized On the other hand, there are stresses which are induced at the break-edges, and thus a chamfer 38 is formed in this embodiment.

As shown in FIG. 6A, the rib 26 has a nominal thickness $t_3$ at the upper end, if not for the chamfers 38. Stated another way, t3 is the distance between sides 200 at the end of chamfers 38. The chamfers 38 extend for a thickness c measured in a plane perpendicular to the top edge 132.

A ratio of c to $t_3$ may be between 0.02-0.15. The use of the chamfer at the break-edge location reduces the stress. There would otherwise be stress concentrations at that area. On the other hand, by utilizing a chamfer within the disclosed range, the amount of surface area available to provide a good adhesion to the cover is still adequate.

Figure 6B:
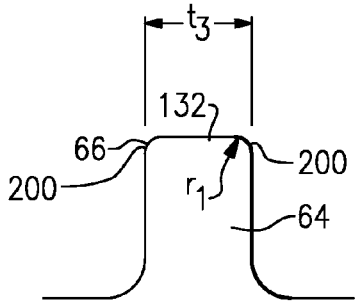
FIG. 6B is another embodiment rib break-edge.

FIG. 6B shows an embodiment of a rib 64, wherein the break-edges are provided along a radius $r_1$. In embodiments, the ratio of $r_1$ to $t_3$ is between 0.02-0.15.

The features of the break-edges are disclosed in co-pending U.S. patent application Ser. No. 13/241,868, filed on even date herewith and entitled "FAN BLADE HAVING INTERNAL RIB BREAK-EDGE."

Figure 7:
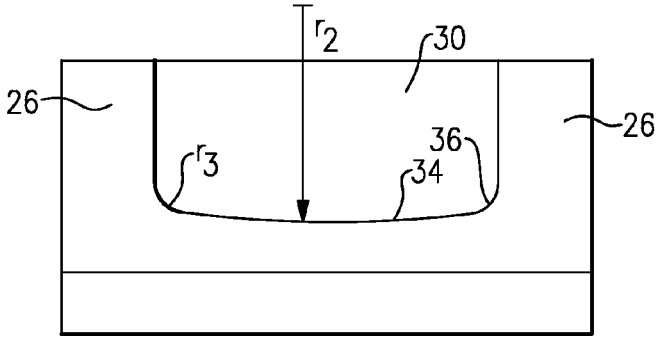
FIG. 7 shows another area within the fan blade.

FIG. 7 shows the surfaces 34 and 36 as illustrated in FIG. 2. The areas at that side of the channels 30 are prone to stress concentrations. A typical fillet, or single curve, may be considered for formation at that area to reduce stress. However, in the disclosed embodiment, a compound fillet having two curves 34 and 36 is utilized. Curve 34 is formed along a radius $r_2$ while curve 36 is formed along a radius $r_3$. A ratio of $r_3$ to $r_2$ is between 0.03 and 0.25. As is clear, $r_2$ is greater than $r_3$. More narrowly, it may be between 0.06 and 0.13. The use of the compound fillet provides a great reduction in stress concentration, which would otherwise be maximized at the general location of the curve 36.

Figure 8:
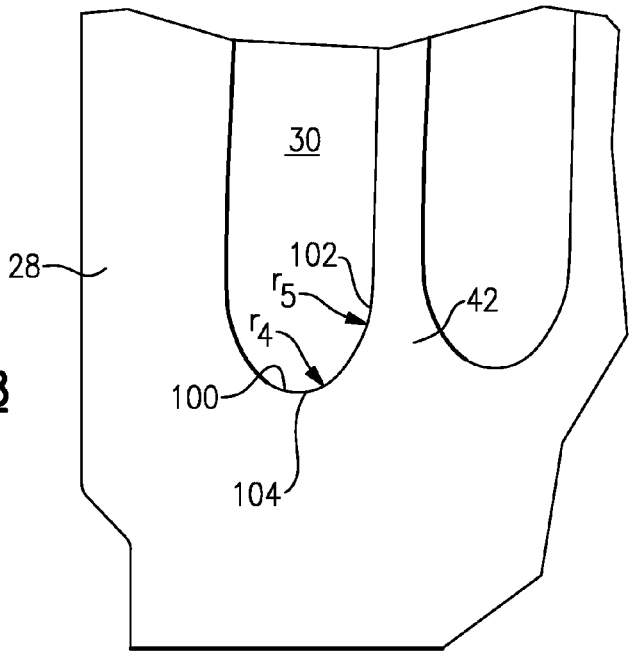
FIG. 8 shows a radially inner end of the channels.

Finally FIG. 8 shows a radially inner end, bottom or termination 100 of a channel 30. As shown, there is a compound curve or fillet including a bottom portion 104 formed at a radius $r_4$ and a side portion 102 formed at a radius $r_5$, which merges into the side of the ribs. As is clear, $r_5$ is greater than $r_4$. Again, this arrangement reduces a stress concentration at the corners which would otherwise be induced into the cavity terminations. In embodiments, a ratio of $r_4$ to $r_5$ is between 0.03 and 0.25.

An Application directed to the features of FIG. 8 has been filed as U.S. patent application Ser. No. 13/241,821, filed on even date herewith and entitled "FAN BLADE CHANNEL TERMINATION."

The compound fillets as disclosed in FIGS. 7 and 8 reduce stress concentrations with minimum weight increase. Further, the compound fillets may be provided with minimal additional cost, because multi-pass machining is not required. Instead, a cutter with a compound radius shape may be utilized.

The fan blade as described above reduces stresses that are raised during operations when mounted in a gas turbine engine.

Although embodiments have been disclosed, a worker of ordinary skill in the art would recognize the modifications which come within the scope of this Application. Thus, the following claims should be studied to determine the true scope and content.

What is claimed is:

1. A fan blade comprising:

a main body extending between a leading edge and a trailing edge, and having channels formed into said main body from an open side extending toward a closed side, a plurality of ribs extend across the main body intermediate the channels with said fan blade having an airfoil extending radially outwardly from a radially inner end;

a bottom surface of the channels is defined at the closed side, and sides of the channel merging into sides of the ribs, and there being a compound fillet at the bottom surface, with a first portion having a first radius of curvature along the bottom, and merging into at least a second portion having a second radius of curvature at the rib sides, with the first radius of curvature being larger than said second radius of curvature;

a skin closing off said channels with the first radius of curvature portion formed along a curve and the second radius of curvature portion formed along a curve and merging from said first radius of curvature portion and into the sides of the ribs; and wherein a ratio of the second radius of curvature to the first radius of curvature is between 0.03-0.25.

2. The fan blade as set forth in claim 1, wherein said ratio is between 0.06 and 0.13.

* * * * *